US006789268B2

(12) United States Patent
Yan

(10) Patent No.: US 6,789,268 B2
(45) Date of Patent: Sep. 14, 2004

(54) CAP AND BACK SUNSHADE

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 17 days.

(21) Appl. No.: 10/349,255

(22) Filed: Jan. 21, 2003

(65) Prior Publication Data

US 2004/0139530 A1 Jul. 22, 2004

(51) Int. Cl.[7] ..... A42B 1/24
(52) U.S. Cl. ..... 2/209.13; 2/175.6; 224/576
(58) Field of Search ..... 2/209.11–209.13, 2/175.6, 207, 206; 206/8

(56) References Cited

U.S. PATENT DOCUMENTS

| | | | | | |
|---|---|---|---|---|---|
| 1,050,310 | A | | 1/1913 | Steinberg et al. | |
| 1,635,916 | A | * | 7/1927 | Benjamin | 2/46 |
| 2,295,826 | A | | 9/1942 | Brav | |
| 2,472,033 | A | * | 5/1949 | Wetzel | 2/4 |
| 2,844,822 | A | | 7/1958 | Persico et al. | |
| 3,750,192 | A | * | 8/1973 | Beresic | 2/422 |
| 4,386,437 | A | | 6/1983 | Fosher | 2/199 |
| 4,980,928 | A | | 1/1991 | Ellis | 2/88 |
| 5,046,195 | A | | 9/1991 | Koritan | 2/172 |
| 5,081,717 | A | * | 1/1992 | Shedd et al. | 2/181.4 |
| 5,355,535 | A | | 10/1994 | Bruder | 2/172 |
| 5,459,881 | A | | 10/1995 | Fagan et al. | 2/209 |
| 5,623,732 | A | | 4/1997 | Olajide, Jr. | 2/195 |
| 5,649,327 | A | * | 7/1997 | Crewe | 2/172 |
| 5,669,075 | A | | 9/1997 | Weeks | 2/172 |
| 5,694,648 | A | | 12/1997 | Nucifora | 2/172 |
| 5,701,609 | A | * | 12/1997 | Bridges | 2/422 |
| 5,742,944 | A | * | 4/1998 | Pfefferman | 2/209.12 |
| D402,088 | S | | 12/1998 | Edwards | D2/865 |
| 5,860,165 | A | | 1/1999 | Cvijanovich | 2/195 |
| 5,887,287 | A | | 3/1999 | Potochnik | 2/209 |
| 5,924,129 | A | | 7/1999 | Gill | 2/10 |
| 5,996,124 | A | * | 12/1999 | Asp, Jr. | 2/209.13 |
| D420,493 | S | | 2/2000 | Blake | D2/866 |
| 6,131,201 | A | | 10/2000 | Chu | 2/172 |
| 6,317,892 | B1 | * | 11/2001 | Galigani | 2/209.11 |
| 6,484,323 | B1 | * | 11/2002 | Pu | 2/410 |

* cited by examiner

*Primary Examiner*—Katherine Moran
(74) *Attorney, Agent, or Firm*—Cislo & Thomas LLP

(57) ABSTRACT

A cap and shade combination in which the shade may be folded inside an attached pouch when not in use. The shade comprises a central portion and two wing portions such that it may be unfurled both down away from the cap and laterally in both directions around the rim of the cap. Each wing portion has an upper edge comprising one or more shade attachment members configured and positioned to removably attach to mating attachment members on the inner surface of the cap near the front visor when in use for maximum coverage of the user's neck, ears, etc. The pouch may be removably attached to the inner surface of the crown of the cap or sewn into or as part of the band or sweatband of the cap.

44 Claims, 4 Drawing Sheets

CAP AND BACK SUNSHADE

BACKGROUND OF THE INVENTION

1. Field of the Invention

This invention relates to caps for wearing outdoors, and in particular, to caps having a shade for shading a portion of the user from the sun.

2. Description of the Related Art

The prior art includes a number of cap and shade combinations. U.S. Pat. No. 6,131,201, for example, discloses a cap having an openable top cover for retaining the shade in an inner space. The sunshade in that patent, however, suffers from, among other things, the fact that the shade is attached to the outside surface of the cap, and is thereby awkward to use and fails to provide the additional support that could be to provided had the shade instead been attached to the inside of the cap where the band of the cap tightly fits around the wearer's head. That patent also suffers from the ill placement of the opening from which the sunshade is released. The zipper for the opening is in plain sight, detracting from the aesthetics of the cap.

Also, the opening is far from the attachment features, which means the sunshade must be entirely detached from the cap before placing in the inner space. This increases the chances that the sunshade will be removed by accident and also increases the chances that the sunshade and the cap will be separated and one of the two will be lost. What is needed is a cap and shade combination that may be made of a one-piece construction so the shade is less likely to be separated from the cap and lost. Alternatively, what is needed is a two-piece construction that is much less likely to allow the shade to be accidentally removed, such as where the removable attachments of the shade are on the inside of the cap where the tight fit to the wearer's head can aid in forcing the two pieces together.

SUMMARY OF THE INVENTION

The present invention is a cap and shade combination in which the shade may be folded inside an attached pouch when not in use. The shade comprises a central portion and two wing portions such that it may be unfurled both down away from the cap and laterally in both directions around the rim of the cap. Each wing portion has an upper edge comprising one or more shade attachment members configured and positioned to removably attach to mating attachment members on the inner surface of the cap near the front visor when in use for maximum coverage of the user's neck, ears, etc.

In one embodiment, the pouch may be stitched into the cap. In another embodiment, it may be removably attached to the inner surface of the crown of the cap, such as by using a hook and loop attachment configuration or using snaps, buttons, clasps, latches, or other common fasteners. In another embodiment, the pouch may be sewn into or as part of the band or sweatband of the cap. The pouch may further have a zipper or other fastening means for alternatively enclosing and releasing the shade. Where the pouch is sewn into or as part of the band, the opening for the shade may open to the inside surface, the outside surface, or the bottom edge of the band.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
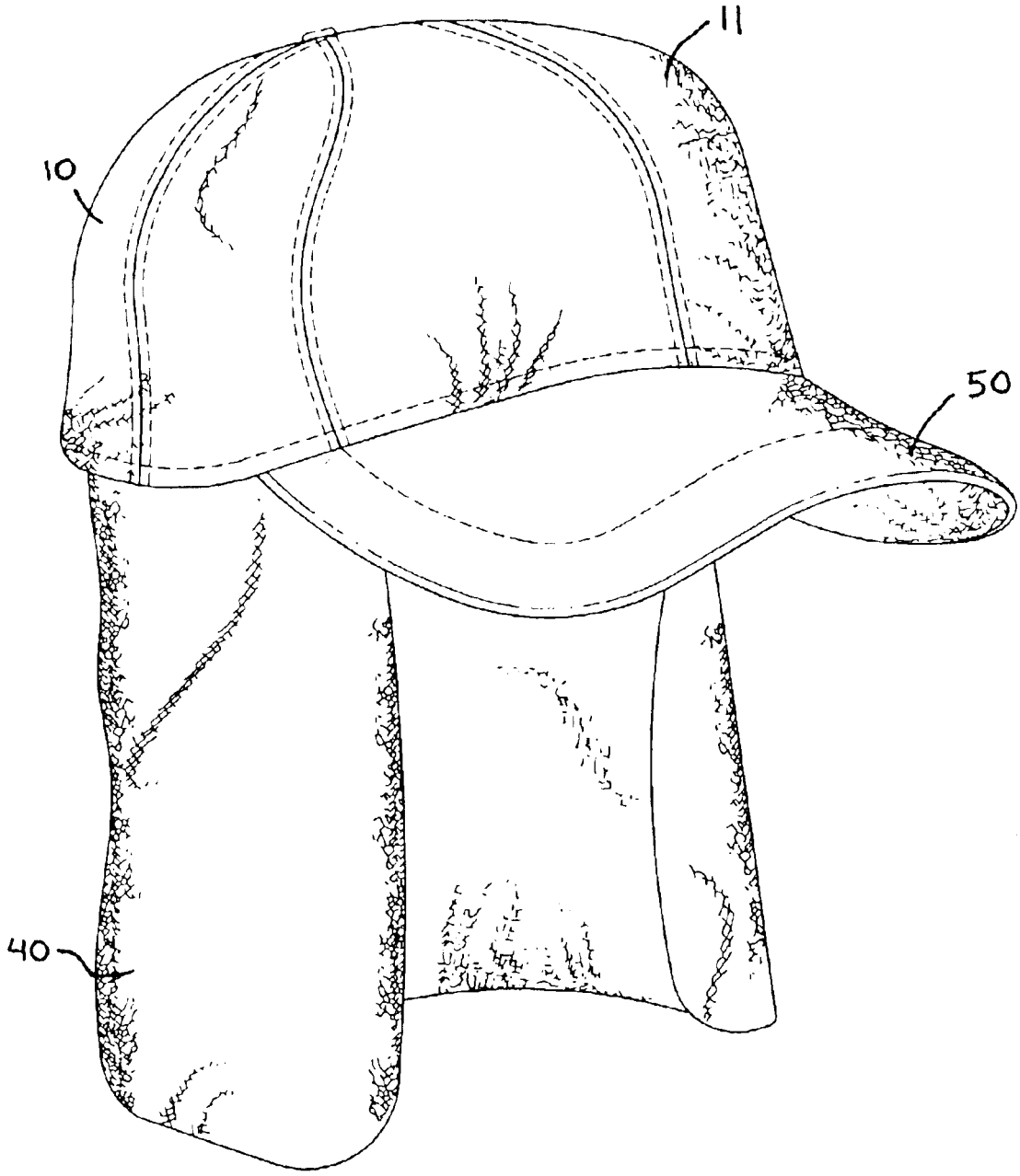
FIG. 1 is a perspective view of one embodiment of the present invention.
Figure 2:
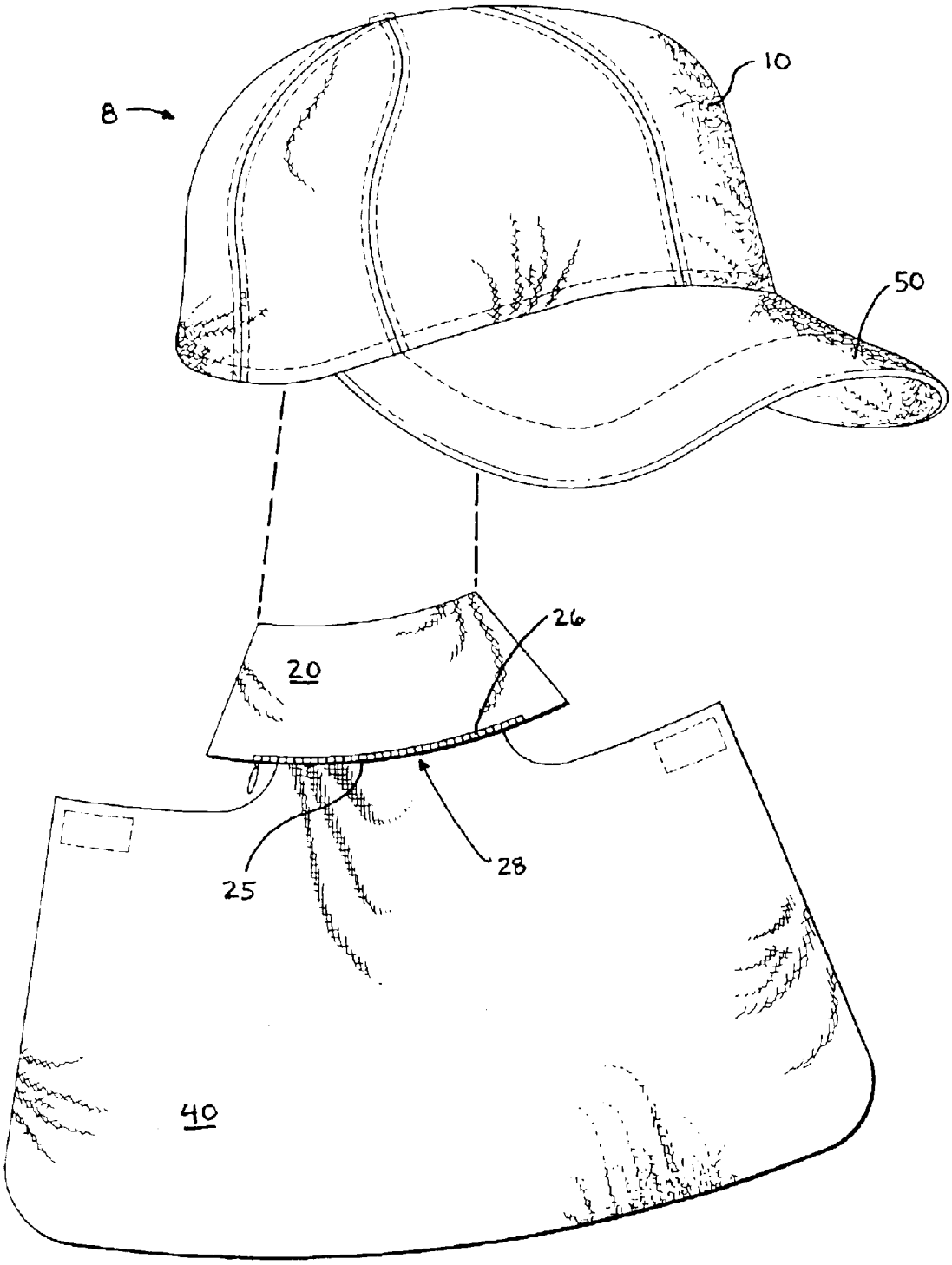
FIG. 2 is an exploded perspective view of the embodiment shown in FIG. 1.

FIGS. 1 and 2 illustrate one embodiment of the present invention, in which there is a cap 8 comprising a crown 10 that is generally convex in shape to fit over and around a portion of the wearer's head. The crown 10 has an outer surface 11, an inner surface 12, and a bottom portion 18. In this embodiment, there also is a visor 50 attached to a front portion 16 of the crown 10, which may be of any standard length and curvature to help shade the wearer's eyes from the sun's rays. In this embodiment, the cap 8 itself appears much like a standard baseball cap when viewed from the outside.

Figure 3:
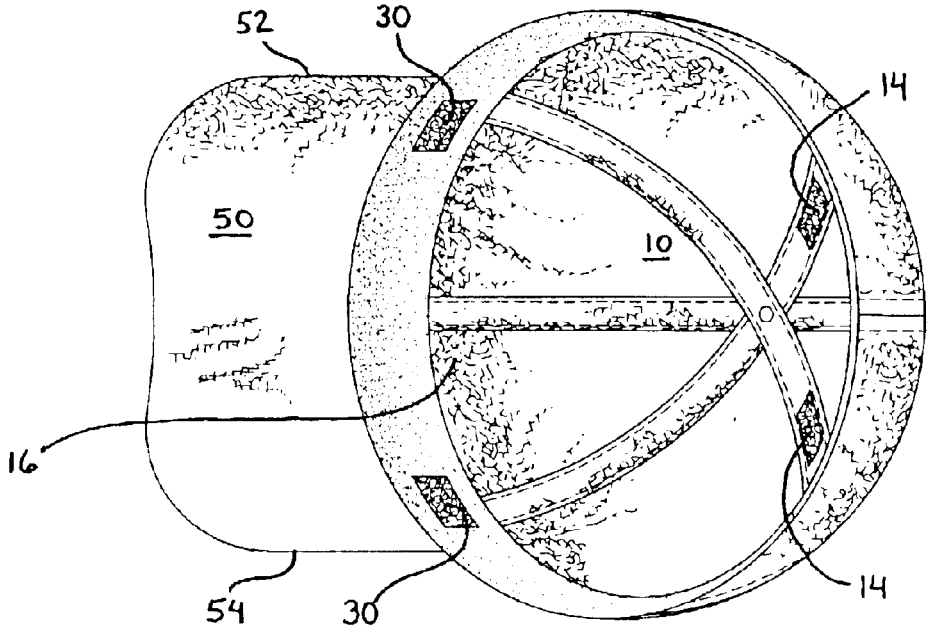
FIG. 3 is a bottom view of a cap in accordance with one embodiment of the present invention.
Figure 4:
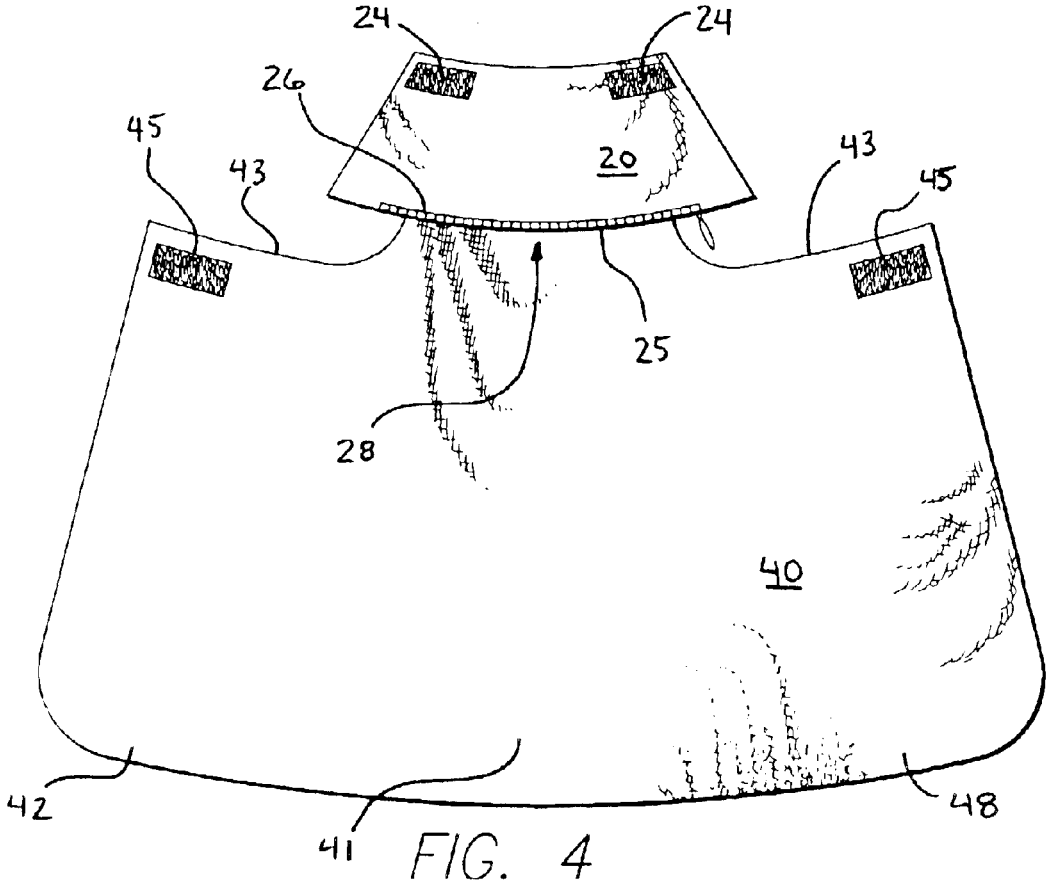
FIG. 4 is a side vide of the backside of a shade in accordance with an embodiment of the present invention.
Figure 5:
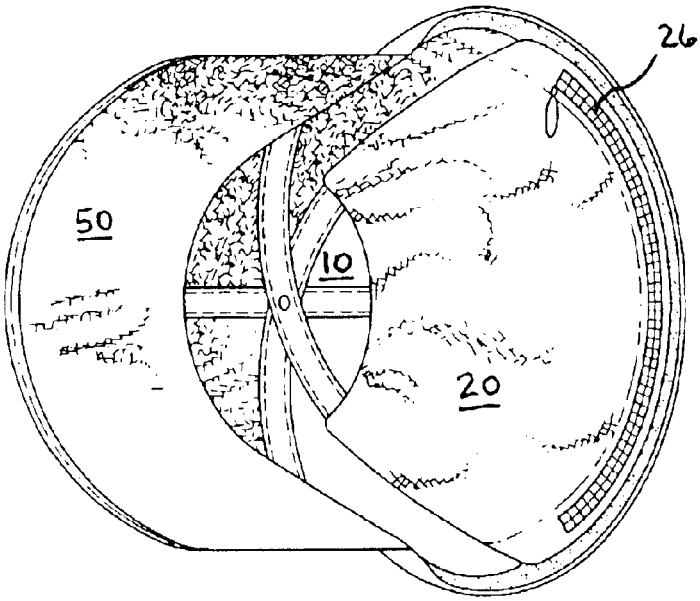
FIG. 5 is a bottom view of an embodiment of the present invention showing a pouch and cap combination in accordance with one embodiment of the present invention.

The inner surface 12 of the crown 10, however, comprises one or more connecting structures 14 as shown in FIG. 3 for securing a pouch 20 to the inner surface 12 of the crown 10 as shown in FIG. 5. The connecting structures 14 shown in FIG. 3 represent one half of a common hook and loop arrangement, and the mating hook and loop structures 24 are located on the backside of the pouch 20 as shown in FIG. 4. The inner surface 12 of the crown 10 also has two or more shade attachment members 30 for receiving mating attachment members 45 as discussed below.

The pouch 20 may be attached to the inner surface 12 of the crown 10 by a number of other connecting structures. The pouch 20 and crown 10, for example, may be stitched together. In such an embodiment, the pouch 20 may not be easily removed from the crown 10. This may be preferable in applications where there is no foreseeable reason to want the pouch 20 to be easily removable from the cap 8 or where easy removal of the pouch 20 from the cap 8 even may be undesirable. In other applications, the pouch 20 may be removably connected to the inner surface 12 of the crown 10 by one or more fastening means, such as buttons, snaps, clasps, latches, or the like, as an alternative to the book and loop arrangement illustrated in FIGS. 3 and 4.

The pouch 20 has an opening 28 defined by one or more edges 25. In one embodiment, a zipper 26 is disposed along edges 25 so that the opening 28 may be closed when desired as shown in FIG. 5. Alternatively, one or more other fastening means may be employed along the edges 25 of the pouch 20, such as one or more buttons, snaps, clasps, latches, hook and loop fasteners, or the like, for closing the opening 28 of the pouch 20.

Contained within the pouch 20 is a shade or sunshade 40. One end of the shade 40 is attached to the inner surface of the pouch 20, and the shade further comprises a is central portion 41, a left side portion 42, and a right side portion 48 as shown in FIG. 2. The left and right side portions each have an upper edge 43 having one or more mating shade attachment members 45. Each mating attachment member 45 is configured and positioned to attach to the shade attachment member 30 on the inner surface 12 of the cap 8. The shade attachment members 30 and mating attachment members 45 shown in FIGS. 3 and 4, respectively, are made of a common hook and loop configuration, but the present invention contemplates any number of other fastening arrangement that would work equally as well, provided that the fastening means allows for easy unfastening as well by the user. Such is the case with many commercially available fasteners, including for example, buttons, snaps, latches, clasps, and the like.

In a preferred embodiment, the two or more mating attachment members 30 are disposed on the inner surface 12 of the crown 10 of cap 8 near the front of the crown 10. The inner surface 12 is utilized in this embodiment to reduce the chances that the shade 40 would be inadvertently unfastened while it is unfurled and in use with the cap 8 is on the wearer's head. That is, whereas U.S. Pat. No. 6,131,201 may suggest that the shade can be attached to the outer surface of the cap, a preferred embodiment of the present invention uses shade attachment members 30 located on the inner surface 12 of the crown 10. As a result, the mating attachment members 45 and upper edges 43 of shade 40 are sandwiched between the crown 10 and the wearer's head. This significantly improves that attachment between the shade 40 and the crown 10 when the user is wearing cap 8.

Additionally, U.S. Pat. No. 6,131,201 may suggest that shade attachment members on the crown may be placed on the side of the crown, but the shade attachment members 30 on the crown 10 in one embodiment of the present invention are instead located in the front portion 16 of crown 10 near the left and right edges 52 and 54, respectively, of the visor 50. This frontal placement of the shade attachment members 30 maximizes the surface of the user's head, neck, and shoulders that is shaded from the sun's rays by the shade 40.

In FIGS. 3 and 4, the shade attachment members 30 and mating attachment members 45 are illustrates as a hook and loop arrangement, but other fasteners work equally as well, such as buttons, snaps, clasps, latches, and the like. The upper edges 43 of said right and left side portions 42 and 48, respectively, may also comprise an elastic portion for tightly conforming to a user's head or for further aiding the mating of the shade attachment members and the mating attachment members 30 and 45.

Figure 6:
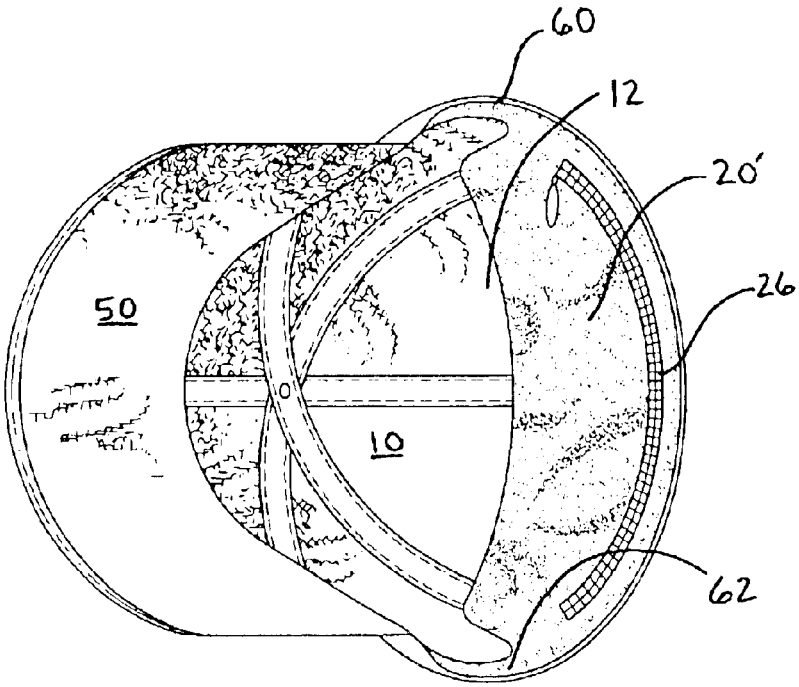
FIG. 6 is a bottom view of an embodiment of the present invention showing a pouch and cap combination in accordance with another embodiment of the present invention.

In another embodiment, shown in FIG. 6, a band or sweatband 60 is attached along the bottom edge 18 of crown 10, and pouch 20' is sewn or otherwise attached to the band 60. The pouch 20' of this embodiment is much like the pouch 20 discussed above, and a preferred embodiment is configured such that the opening 28 of the pouch 20' opens along the inside surface 62 of band 60, as shown in FIG. 6. Alternatively, pouch 20' could be configured to open on the outside surface of band 60, or to open along the bottom edge of band 60. Also, the pouch 20' shown in FIG. 6 may be integrally formed in the sweatband 60, but it may alternatively be made as a separate unit sewn onto or removably attached to the sweatband 60, either on its inside surface, on its outside surface, or along its bottom edge, depending on the needs of the particular application.

While the present invention has been described with regards to particular embodiments, it is recognized that additional variations of the present invention may be devised without departing from the inventive concept.

What is claimed is:

1. A cap comprising:

a crown having an inner surface and an outer surface, two or more shade attachment members on said inner surface of said crown near a front portion thereof, a pouch attached to said inner surface of said crown, and a shade contained within said pouch, said shade comprising a central portion, a left side portion, and a right side portion, said left and right side portions each having an upper edge comprising one or more mating attachment members, wherein said at least one mating attachment members of said left and right side portions are configured and positioned to attach to said shade attachment members during use.

2. The cap as defined by claim 1 wherein said pouch is removably attached to said crown.

3. The cap as defined by claim 2 wherein said pouch is removably attached to said crown by one or more fasteners.

4. The cap as defined by claim 1 wherein said pouch further comprises one or more edges defining an opening for releasing a portion of said shade.

5. The cap as defined by claim 4 wherein said one or more edges of said pouch comprise one or more fasteners for closing said opening and thereby retaining said shade.

6. The cap as defined by claim 1 wherein said shade attachment members are fastening means.

7. The cap as defined by claim 1, further comprising a visor affixed to a front portion of said crown having left and right edges.

8. The cap as defined by claim 7 wherein said shade attachment members are located near the left and right edges of the visor.

9. The cap as defined by claim 1, further comprising a band attached near a bottom edge of the crown, wherein said pouch is attached to said band.

10. The cap as defined by claim 9 wherein said pouch further comprises one or more edges defining an opening for releasing a portion of said shade.

11. The cap as defined by claim 10 wherein said one or more edges of said pouch comprise one or more fasteners for closing said opening and thereby retaining said shade.

12. The cap as defined by claim 10 wherein said edges of said pouch are disposed on an inside surface of said band.

13. The cap as defined by claim 10 wherein said edges of said pouch are disposed on an outside surface of said band.

14. The cap as defined by claim 10 wherein said edges of said pouch are disposed along a bottom edge of said band.

15. A pouch and shade combination for attachment to a cap, comprising:

a pouch having one or more edges defining an opening, and a shade contained within said pouch that is configured to be released through said opening, said shade comprising a central portion, a left side portion, and a right side portion, wherein said left and right side portions each have an upper edge comprising one or more shade attachment members configured and positioned for removably attaching to mating attachment members on an inner surface of said cap disposed near a front portion of said cap.

16. The pouch and shade combination as defined by claim 15 wherein said pouch is adapted for attachment to an inner surface of a cap.

17. The pouch and shade combination as defined by claim 15 wherein said pouch is removably attached to said cap.

18. The pouch and shade combination as defined by claim 17 wherein said pouch is removably attached to said cap by one or more fastening means.

19. The pouch and shade combination as defined by claim 15 wherein said one or more edges of said pouch comprise one or more fasteners for closing said opening and thereby retaining said shade.

20. The pouch and shade combination as defined by claim 15 wherein said shade attachment members are fastening means.

21. The pouch and shade combination as defined by claim 15, wherein said shade attachment members are configured and positioned to attach to said mating attachment members on said cap disposed near left and right edges of a visor attached to a front portion of said cap.

22. The pouch and shade combination as defined by claim 15, wherein said pouch is attached to a band of said cap near a bottom edge of the cap.

23. The pouch and shade combination as defined by claim 22 wherein said pouch further comprises one or more edges defining an opening for releasing a portion of said shade.

24. The pouch and shade combination as defined by claim 23 wherein said one or more edges of said pouch comprise one or more fasteners for closing said opening and thereby retaining said shade.

25. The pouch and shade combination as defined by claim 23 wherein said edges of said pouch are disposed on an inner surface of said band.

26. The pouch and shade combination as defined by claim 23 wherein said edges of said pouch are disposed on an outer surface of said band.

27. The pouch and shade combination as defined by claim 23 wherein said edges of said pouch are disposed along a bottom edge of said band.

28. A shade for attaching to a cap comprising:

a central portion, a left side portion, and a right side portion, said left and right side portions each having an upper edge comprising one or more shade attachment members, and a pouch into which said central, left side, and right side portions are folded when not in use, wherein said pouch comprises one or more fastening means for fastening to an inner surface of a cap, and wherein said one or more shade attachment members are configured and positioned to attach to two or more mating attachment members on said inner surface of the cap near a front visor of the cap.

29. The shade as defined by claim 28 wherein said pouch is adapted to be removably attached to said cap.

30. The shade as defined by claim 29 wherein said pouch includes one or more fasteners.

31. The shade as defined by claim 28 wherein said one or more edges of said pouch comprise one or more fasteners for closing said opening and thereby retaining said shade.

32. The shade as defined by claim 28, wherein said mating attachment members are configured and positioned to mate with complementing attachment members on said cap disposed near left and right edges of said front visor.

33. The shade as defined by claim 28, wherein said pouch is adapted for attachment to a band of said cap near a bottom edge of the cap.

34. The shade as defined by claim 33 wherein said pouch further comprises one or more edges defining an opening for releasing a portion of said shade.

35. The shade as defined by claim 34 wherein said one or more edges of said pouch comprise one or more fasteners for closing said opening and thereby retaining said shade.

36. The pouch and shade combination as defined by claim 35 wherein said pouch is removably attached to said cap by one or more fasteners.

37. The pouch and shade combination as defined by claim 34 wherein said edges of said pouch are adapted to be disposed on an inner surface of said band.

38. The pouch and shade combination as defined by claim 34 wherein said edges of said pouch are adapted to be disposed along a bottom edge of said band.

39. A cap comprising:

a crown having an inner surface and an outer surface, two or more shade attachment members on said inner surface of said crown near a front portion thereof, a pouch attached to said inner surface of said crown, wherein said pouch is removably attached to said crown, and a shade contained within said pouch, said shade comprising a central portion, a left side portion, and a right side portion, said left and right side portions each having an upper edge comprising one or more mating attachment members, wherein said at least one mating attachment members of said left and right side portions are configured and positioned to attach to said shade attachment members during use.

40. The cap of claim 39 wherein said pouch is removably attached to the crown by one or more fasteners.

41. The cap of claim 39 wherein said pouch further comprises one or more edges defining an opening for releasing a portion of said shade, wherein said edges of said pouch are disposed on an inside surface of said band.

42. A pouch and shade combination for attachment to a cap, comprising:

a pouch having one or more edges defining an opening, wherein said pouch is removably attached to said cap, and a shade contained within said pouch that is configured to be released through said opening, and comprising a central portion, a left side portion, and a right side portion, wherein said left and right side portions each have an upper edge comprising one or more shade attachment members configured and positioned for removably attaching to mating attachment members on an inner surface of said cap disposed near a front portion of said cap.

43. The pouch and shade combination of claim 42 wherein said pouch is removably attached to said cap by one or more fastening means.

44. A pouch and shade combination for attachment to a cap, comprising:

a pouch having one or more edges defining an opening, and a shade contained within said pouch that is configured to be released through said opening, and comprising a central portion, a left side portion, and a right side portion, wherein said left and right side portions each have an upper edge comprising one or more shade attachment members configured and positioned for removably attaching to mating attachment members on an inner surface of said cap disposed near a front portion of said cap, wherein the pouch is attached to a band of said cap near a bottom edge of the cap, wherein said pouch further comprises one or more edges defining an opening for releasing a portion of said shade, and wherein said edges of said pouch are disposed on an inner surface of said band.

* * * * *